US006598757B2

(12) United States Patent
Stillinger et al.

(10) Patent No.: US 6,598,757 B2
(45) Date of Patent: Jul. 29, 2003

(54) PIERCING DRINK SPOUT SYSTEM

(75) Inventors: Scott H. Stillinger, Monte Sereno, CA (US); Donald J. Panec, South San Francisco, CA (US)

(73) Assignee: Acorn Bay, LLC, South San Francisco, CA (US)

( * ) Notice: Subject to any disclaimer, the term of this patent is extended or adjusted under 35 U.S.C. 154(b) by 29 days.

(21) Appl. No.: 09/754,953

(22) Filed: Jan. 3, 2001

(65) Prior Publication Data

US 2002/0017528 A1 Feb. 14, 2002

Related U.S. Application Data

(60) Provisional application No. 60/174,474, filed on Jan. 3, 2000.

(51) Int. Cl.[7] ..... B65D 47/08; B67B 7/24

(52) U.S. Cl. ..... 220/712; 220/713; 220/714; 215/387; 222/83

(58) Field of Search ..... 220/714, 712, 220/713, 490; 215/387, 388; 212/83

(56) References Cited

U.S. PATENT DOCUMENTS

| | | | |
|---|---|---|---|
| 274,474 | A | 3/1883 | Kennish |
| 688,531 | A | 3/1901 | Rieke |
| 1,550,305 | A | 8/1925 | Dresicherf |
| 2,194,011 | A | 3/1940 | Davidson |
| 2,533,305 | A | 12/1950 | Wells |

(List continued on next page.)

FOREIGN PATENT DOCUMENTS

| | | | |
|---|---|---|---|
| DE | 1087968 | | 8/1960 |
| DE | 31659 | | 9/1964 |
| DE | 586787 | A1 | 3/1993 |
| EP | 0385603 | B1 | 2/1990 |
| GB | 2217677 | A | 11/1989 |
| JP | 45-37339 | | 11/1970 |
| WO | WO98/45184 | | 10/1998 |
| WO | WO 99/37552 | | 7/1999 |
| WO | WO00/16667 | | 3/2000 |
| WO | WO00/16668 | | 3/2000 |

OTHER PUBLICATIONS

Fig. 5 of what is believed to be a British patent from 1909.
English language abstract of European Patent No. EP 589787A1, 1993.
English language abstract of Soviet Union Patent No. SU925408,1992.

*Primary Examiner*—Joseph M. Moy
(74) *Attorney, Agent, or Firm*—Kolisch Hartwell, P.C.

(57) ABSTRACT

Drink spout systems for use with drink containers. The drink spout systems are configured to easily pierce a drink container or a seal across an opening in the drink container to access the drink fluid contained within the drink container. The drink spout system may include a valve assembly to regulate the flow of the drink fluid through the drink spout. The drink spout system may additionally or alternatively include a valve assembly that is configured to prevent drink fluid from being unintentionally dispensed from the drink container, such as when the drink container is pierced by the drink spout system or when the drink container is tipped over or dropped. The drink spout system is particularly useful on aseptic drink pouches, aseptic drink boxes, drink bottles and other similar drink containers.

53 Claims, 8 Drawing Sheets

U.S. PATENT DOCUMENTS

| | | | |
|---|---|---|---|
| 2,676,744 | A | 4/1954 | Baselt |
| 2,691,466 | A | 10/1954 | Efford et al. |
| 2,773,722 | A | 12/1956 | Abplanalp |
| 2,781,956 | A | 2/1957 | Sherbondy |
| 2,802,608 | A | 8/1957 | Gassaway |
| 2,805,809 | A | 9/1957 | Pugh |
| 2,898,018 | A | 8/1959 | Borah |
| 2,948,453 | A | 8/1960 | Drown |
| 3,042,319 | A | 7/1962 | Burd |
| 3,067,787 | A | 12/1962 | Salk |
| 3,093,273 | A | 6/1963 | Borah |
| 3,165,241 | A | 1/1965 | Curry |
| 3,268,792 | A | 8/1966 | Barmherzig |
| 3,285,477 | A | 11/1966 | Marona et al. |
| 3,298,577 | A | 1/1967 | Chlystun |
| 3,372,832 | A | 3/1968 | Yeater et al. |
| 3,620,421 | A | 11/1971 | MacGuire-Cooper |
| 3,690,522 | A | 9/1972 | Chlystun |
| 3,819,151 | A | 6/1974 | Kish |
| 4,019,663 | A | 4/1977 | Krautkramer |
| 4,133,319 | A | 1/1979 | Bloomfield |
| 4,159,790 | A | 7/1979 | Bailey |
| 4,165,825 | A | 8/1979 | Hansen |
| 4,179,052 | A | 12/1979 | Abbott |
| 4,189,072 | A | 2/1980 | Conn |
| 4,245,752 | A | 1/1981 | Prueher |
| 4,417,672 | A | 11/1983 | Eppenbach |
| 4,422,563 | A | 12/1983 | Babiol |
| 4,450,985 | A | 5/1984 | Beard |
| 4,483,465 | A | 11/1984 | Lawrence |
| 4,555,048 | A | 11/1985 | Hamman et al. |
| 4,560,081 | A | 12/1985 | Adams |
| 4,714,173 | A | 12/1987 | Ruiz |
| 4,723,689 | A | 2/1988 | Vallos et al. |
| 4,726,491 | A | 2/1988 | Moon |
| 4,728,006 | A | 3/1988 | Drobish et al. |
| 4,776,495 | A | 10/1988 | Vignot |
| 4,801,007 | A | 1/1989 | Rule |
| 4,828,141 | A | 5/1989 | Coy |
| 4,848,601 | A | 7/1989 | Reil |
| 4,927,061 | A | 5/1990 | Leigh et al. |
| 4,941,598 | A | 7/1990 | Lambelet, Jr. et al. |
| 4,946,062 | A | 8/1990 | Coy |
| 5,004,126 | A | 4/1991 | Klesius |
| 5,039,012 | A | 8/1991 | Inaba |
| 5,052,575 | A | 10/1991 | Ravreby |
| 5,052,614 | A | 10/1991 | Xuan |
| 5,072,842 | A | 12/1991 | White |
| 5,088,614 | A | 2/1992 | Dumestre |
| 5,141,133 | A | 8/1992 | Ninomiya et al. |
| 5,158,633 | A | 10/1992 | Rausing |
| 5,169,026 | A | 12/1992 | Patterson |
| 5,244,113 | A | 9/1993 | Stymiest |
| 5,249,708 | A | 10/1993 | Magness |
| 5,255,813 | A | 10/1993 | Berggren et al. |
| 5,301,858 | A | 4/1994 | Hollander |
| 5,339,982 | A | 8/1994 | Tardie |
| 5,366,114 | A | 11/1994 | Bernstein et al. |
| 5,431,308 | A | 7/1995 | Tchen |
| 5,465,866 | A | 11/1995 | Belcastro |
| 5,791,510 | A | 8/1998 | Paczonay |
| 5,823,422 | A | 10/1998 | Collier et al. |
| 5,850,908 | A | 12/1998 | Jasek |
| 5,850,930 | A | 12/1998 | Jonsson et al. |
| 5,855,298 | A | 1/1999 | Teetsel, III et al. |
| 5,860,540 | A | 1/1999 | Bock |
| 5,860,586 | A | 1/1999 | Anchor et al. |
| 5,884,837 | A | 3/1999 | Jacobsson et al. |
| 5,947,318 | A | 9/1999 | Palm |
| 6,076,704 | A | 6/2000 | Weiler et al. |
| 6,135,311 | A | 10/2000 | Panec et al. |

Fig. 17
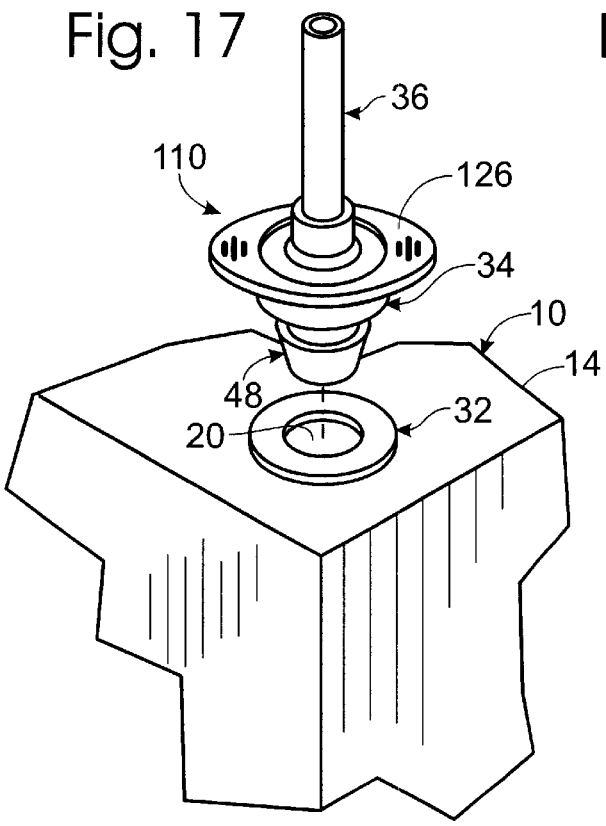
Fig. 18
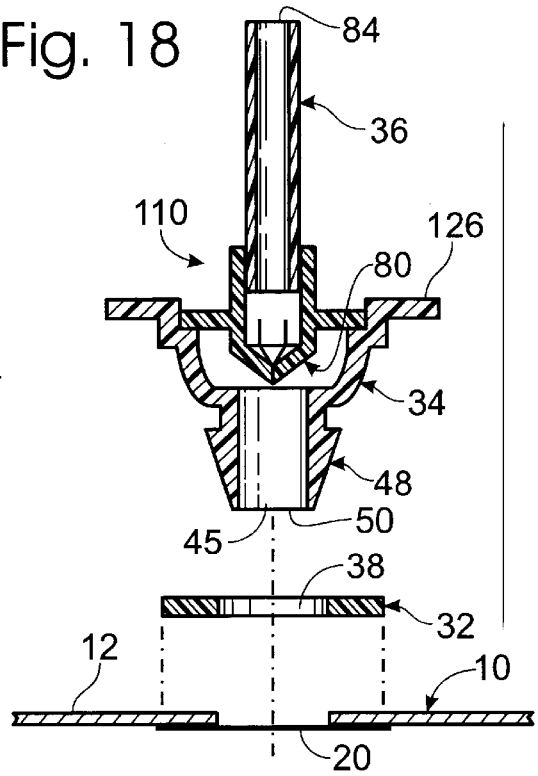
Fig. 20
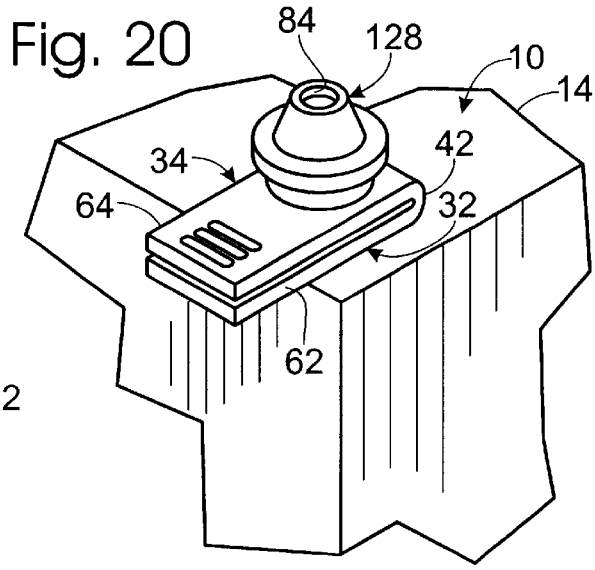
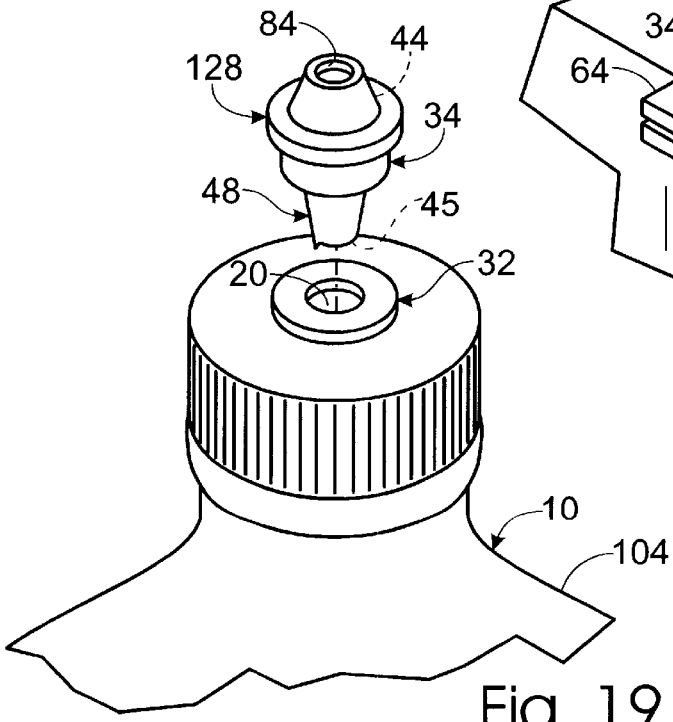
Fig. 19

Fig. 21
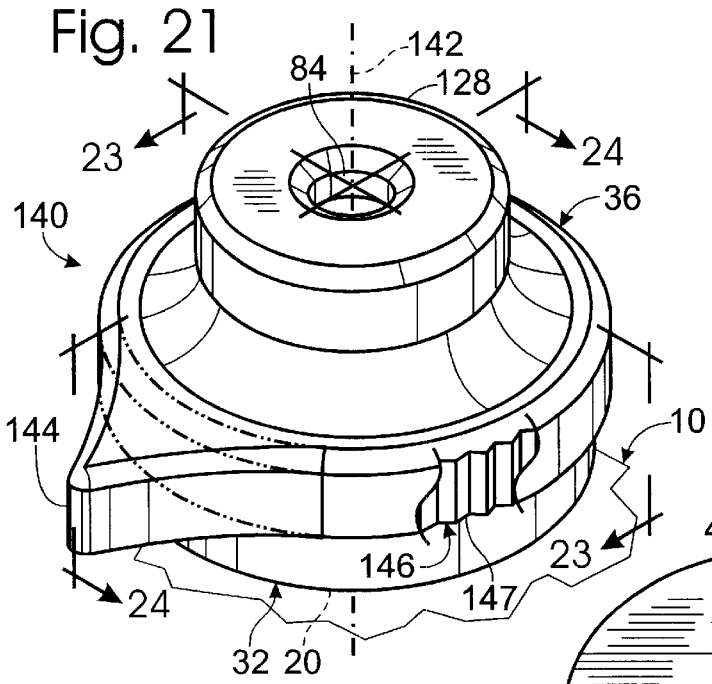
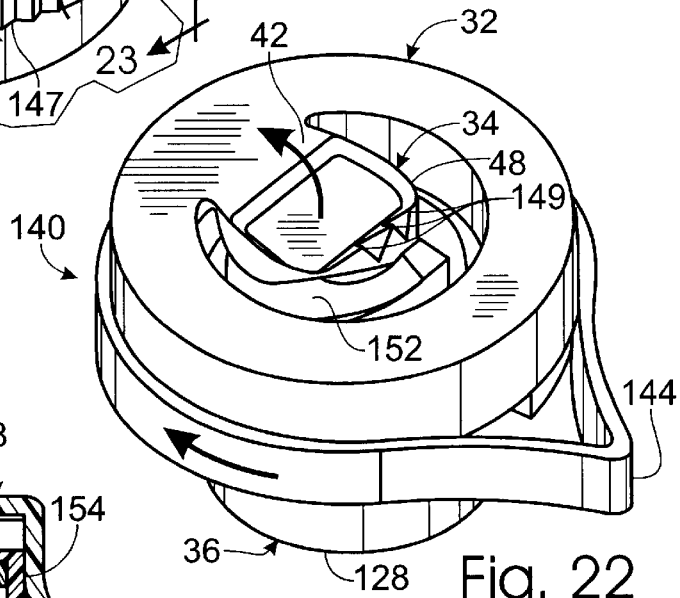
Fig. 22
Fig. 23
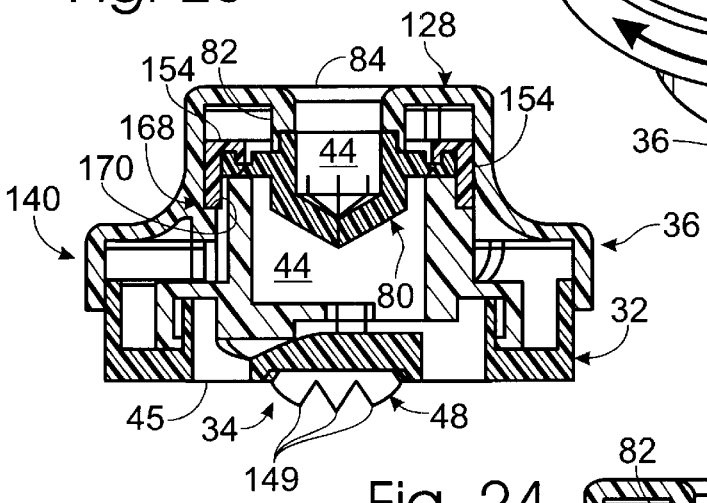
Fig. 24
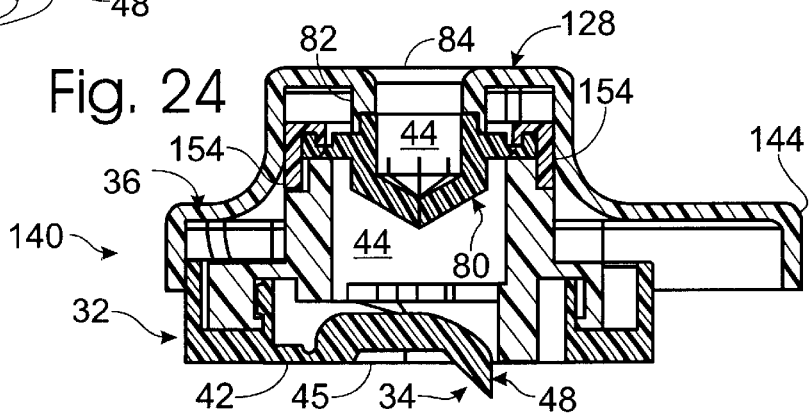

PIERCING DRINK SPOUT SYSTEM

RELATED APPLICATION

The present application claims priority to co-pending U.S. provisional Patent application Ser. No. 60/174,474, which was filed on Jan. 3, 2000, is entitled "Piercing Drink Spout System," and the complete disclosure of which is hereby incorporated by reference.

FIELD OF THE INVENTION

This invention relates generally to drink spouts and drink valves, and more particularly to drink spouts that include a piercing portion adapted to pierce a beverage container to access a drink beverage within the container.

BACKGROUND OF THE INVENTION

Aseptic drink pouches and boxes have become popular ways to conveniently package and sell drinks. An aseptic drink pouch is a flexible pouch that is typically formed from plastic or plastic and foil and which is free or freed from pathogenic microorganisms. An aseptic drink box is a box that is free or freed from pathogenic microorganisms. Aseptic drink boxes are typically formed of cardboard, paper, plastic, foil and combinations thereof. Drink boxes typically include a plastic liner, wax coating or other suitable liner or coating to provide a waterproof enclosure for a drink fluid. An aseptic drink pouch or box typically includes a hole in the top of the pouch or box covered by thin layers of plastic and/or foil. The pouch or box is sold with a straw that is used to pierce the foil and plastic and extend through the hole for drinking. However, drink pouches and boxes have the drawback of allowing liquid to spill. For example, drink pouches and boxes often spill when the straw is inserted because the user is holding the pouch or box in one hand while trying to insert the straw through the foil and plastic into the straw hole. The pressure of holding the pouch or box and pressing the straw against the foil and plastic covering the hole often causes the liquid to spray out of the hole or out of the straw as the foil and plastic are pierced. Drink pouches and boxes also spill when tipped because the straws used to pierce and drink from the pouches or boxes do not include a closable valve for preventing liquid from being dispensed through the straws.

Other drink boxes include drink, or pour, spouts that extend outward from the drink box and include screw caps that are threadingly engaged on the drink spouts. Examples of these drink boxes are "gable-top" drink boxes that are used for milk and some juices. The screw cap allows the box to be sealed when the cap is in place, but it does not provide any form of valve, much less an automatically closing valve to prevent spills. These gable-top drink boxes include a removable inner seal that must be removed before the contents of the box may be dispensed through the drink spout. A company called Tetra Pak has also introduced in 2000 a cap for aseptic boxes that, upon rotation of the cap, biases via cam action a pivotal tooth through the inner seal so that the inner seal does not have to be physically removed. However, the cap still needs to be removed to dispense fluid, and the cap must be replaced to prevent leaks.

Drinks are also packaged and sold in drink bottles, which are typically formed of plastic or glass. These bottles often include a foil or plastic seal that covers the opening of the bottle and that must be removed before a user can drink out of the bottle. Once removed, the drink may spill if the bottle is tipped.

SUMMARY OF THE INVENTION

The inventions described herein provide a drink spout system capable of easily piercing a drink container or a seal across an opening in the drink container to access the drink fluid contained within the drink container. The drink spout system may include a valve assembly to regulate the flow of the drink fluid through the drink spout. The drink spout system may additionally or alternatively include a valve assembly that is configured to prevent drink fluid from being unintentionally dispensed from the drink container, such as when the drink container is pierced by the drink spout system or when the drink container is tipped over or dropped. The drink spout system is particularly useful on aseptic drink pouches, aseptic drink boxes, drink bottles and other similar drink containers.

BRIEF DESCRIPTION OF THE DRAWINGS

FIG. 17 is a fragmentary isometric view of another drink spout system according to the present invention, with the drink spout system shown positioned above a drink box.

FIG. 18 is a cross-sectional view of the drink spout system and drink box of FIG. 17.

FIG. 19 is a fragmentary isometric view of another drink spout system according to the present invention, with the drink spout system shown positioned above a drink bottle.

FIG. 20 is a fragmentary isometric view of another drink spout system according to the present invention mounted on a drink box.

FIG. 21 is an isometric view of the upper surface of another drink spout system according to the present invention.

FIG. 22 is an isometric view of the lower surface of the drink spout system of FIG. 21.

FIG. 23 is a cross-sectional view of the drink spout system of FIG. 21 taken along the line 23—23 in FIG. 21.

FIG. 24 is a cross-sectional view of the drink spout system of FIG. 22 taken along the line 24—24 in FIG. 21.

DETAILED DESCRIPTION AND BEST MODE OF THE INVENTION

Figure 1:
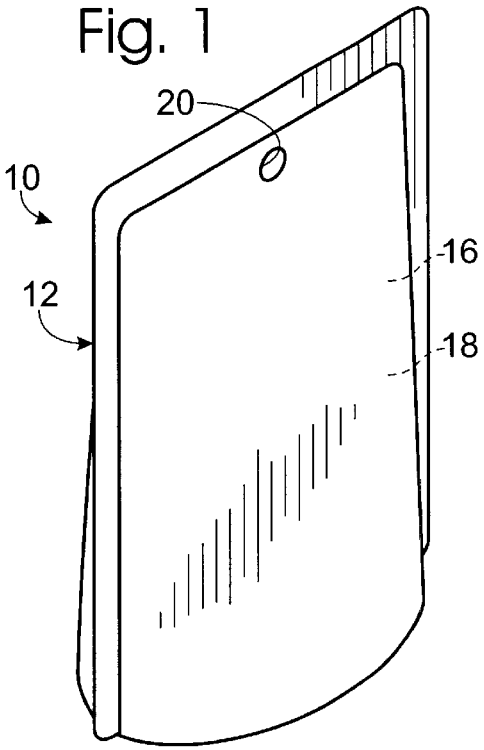
FIG. 1 is an isometric view of an aseptic drink pouch.
Figure 2:
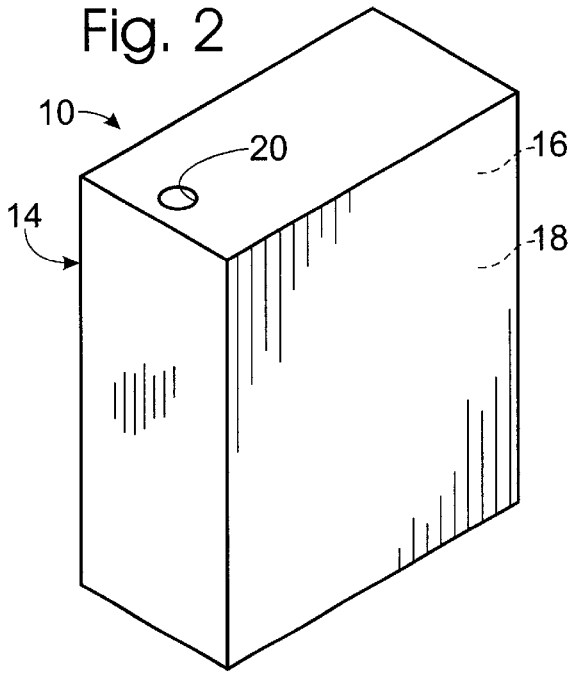
FIG. 2 is an isometric view of an aseptic drink box.

Examples of aseptic drink containers are shown in FIGS. 1 and 2 and generally indicated at 10. More specifically, FIG. 1 shows an aseptic drink pouch 12, and FIG. 2 shows an aseptic drink box 14. Each drink container defines an internal compartment 16 that is adapted to receive a volume of a drink fluid 18, such as water, juice, sports drinks, fruit-flavored drinks, milk products, health or dietary beverages, and the like. As used herein, the term "drink container" is meant to refer to hand-held, typically prepackaged containers that contain a drink fluid and which a user may drink directly from. Typically the drink containers contain less than approximately a gallon of drink fluid, and more typically contain approximately a liter or less of drink fluid. Illustrative examples are drink containers that are prepackaged to hold 4, 6, 8, 12, 16 and 20 ounces of drink fluid.

Drink containers 10 further include a seal, or piercing region, 20 that is adapted to be pierced to dispense the drink fluid from the container. Conventionally, straws are used to pierce region 20, and then these straws are sucked on by a user to draw the drink fluid from compartment 16. Region 20 also may be referred to as a seal region or piercing region. It should be understood that region 20 may be a specialized region on the drink container, such as a region of decreased thickness or a region that requires less force to pierce. However, region 20 may also be the particular user-selected region on the drink container that is pierced by a straw or other device. Drink boxes generally have defined piercing regions, while drink pouches typically have either defined piercing regions or piercing regions selected by the user.

Figure 3:
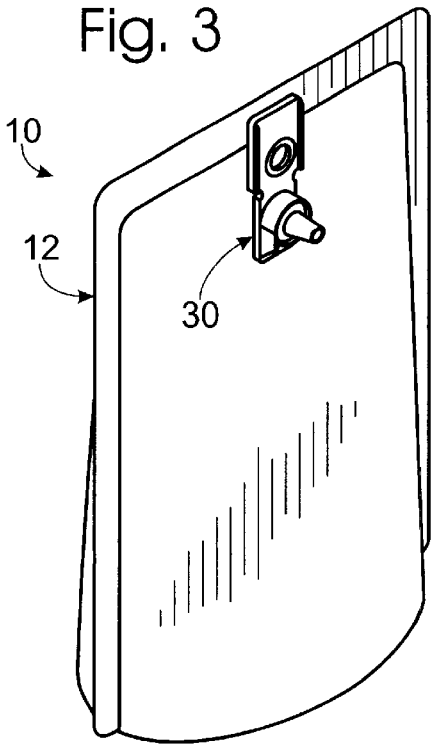
FIG. 3 is a fragmentary isometric view of the drink pouch of FIG. 1 with a drink spout system according to the present invention.
Figure 4:
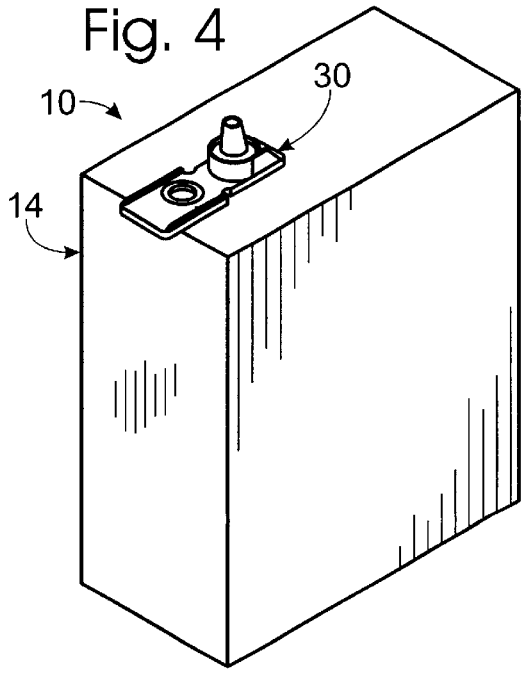
FIG. 4 is a fragmentary isometric view of the drink box of FIG. 2 with a drink spout system according to the present invention.

Unlike the straws that have been used to pierce regions 20, the present invention provides an improved drink spout system 30, which is shown in FIGS. 3 and 4 mounted on drink pouch 12 and drink box 14. As perhaps best seen in FIG. 5, drink spout system 30 includes a base portion 32, a piercing portion 34, and a dispensing portion 36.

Base portion 32 couples the piercing portion to the drink container. As such, base portion 32 may also be referred to as a mount or mounting structure. As shown in FIGS. 5–9, the base and piercing portions are pivotally coupled together by a hinge assembly 42 that may have any suitable form. In the illustrated embodiment, the hinge assembly is a living hinge formed with the base and piercing portions. It should be understood that it is within the scope of the invention that these portions may be separately formed and then joined together by a suitable hinge assembly. As discussed subsequently, it is also within the scope of the present invention that the base and piercing portions are not pivotally coupled together.

Figure 5:
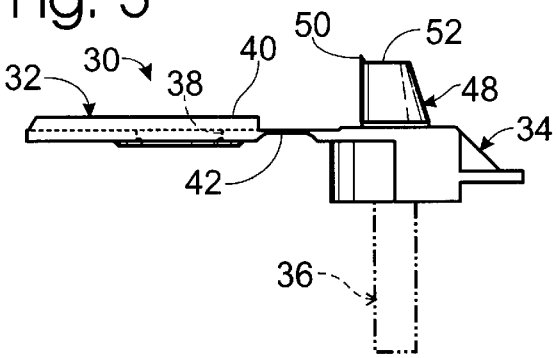
FIG. 5 is a side elevation view of a drink spout system constructed according to the present invention, with the system configured in an open, or unpierced, configuration.
Figure 8:
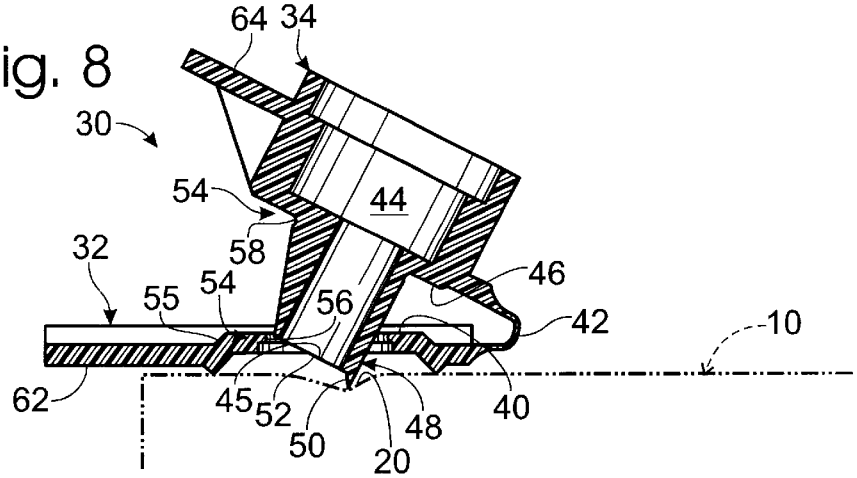
FIG. 8 is a cross-sectional view of the drink spout system of FIG. 7 with the piercing portion pivoted from the position shown in FIG. 7 to a position for piercing the seal of the drink container.
Figure 9:
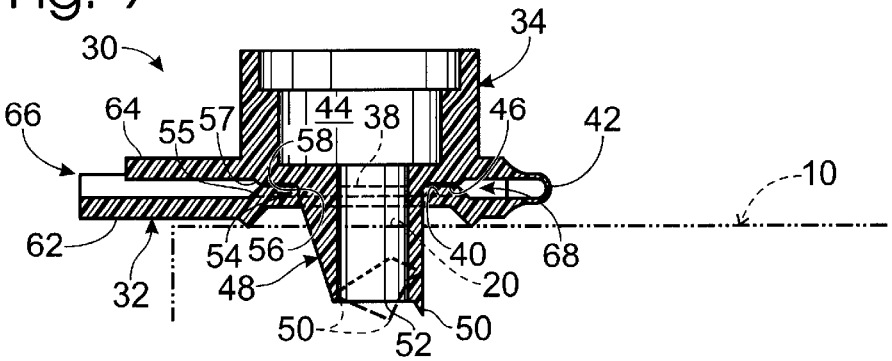
FIG. 9 is a cross-sectional view of the drink spout system of FIG. 7 with the piercing portion in a pierced, or dispensing, orientation, and with other suitable piercing members shown in dashed lines.

Hinge assembly 42 allows the base and piercing portions to pivot with respect to each other from an unpierced, or open configuration, such as shown in FIG. 5, to the piercing orientation shown in FIG. 9. In the open configuration the piercing portion is not in a position for piercing region 20 of a drink container. In the piercing orientation, the piercing portion is positioned to pierce, and preferably to further extend at least partially through, region 20. In the piercing orientation, a sufficient portion of the piercing portion is passed through aperture 38 to pierce and pass through the piercing region of the drink container and to allow drink fluid 18 to be withdrawn therethrough. Because the piercing region of the drink container will often initially deflect away from the piercing portion before allowing the piercing portion to pass therethrough, such as shown in FIG. 8, the piercing portion should be sized to accommodate this deflection of the drink container's piercing region.

In embodiments of the drink spout system in which the piercing portion is pivotally coupled to the base portion, the base portion defines, at least in part, the region of the drink container to be pierced by the piercing portion. For example, in the embodiment shown in FIGS. 6 and 7, base portion 32 includes an aperture 38 that defines piercing portion 34. It is within the scope of the present invention that the base portion may define the region to be pierced by only partially surrounding the region, or may define this region simply by providing a mount, or hinge point, for piercing portion 34. Base portion 32 may be formed with the drink container or mounted on the drink container, such as by an adhesive or other suitable attachment or fastening mechanism. In the illustrated embodiment, the base portion includes a contact surface 40 against which the piercing portion abuts or into which the piercing portion is received when the drink spout system is in its piercing orientation, shown in FIG. 9.

Figure 6:
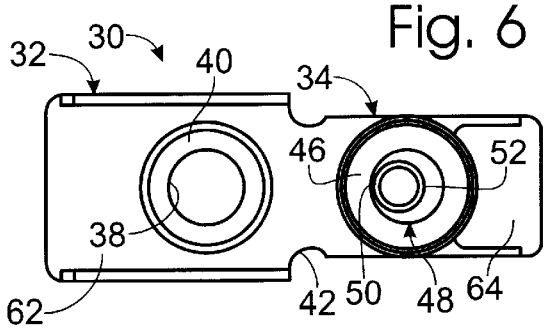
FIG. 6 is a top plan view of the drink spout system of FIG. 5.
Figure 7:
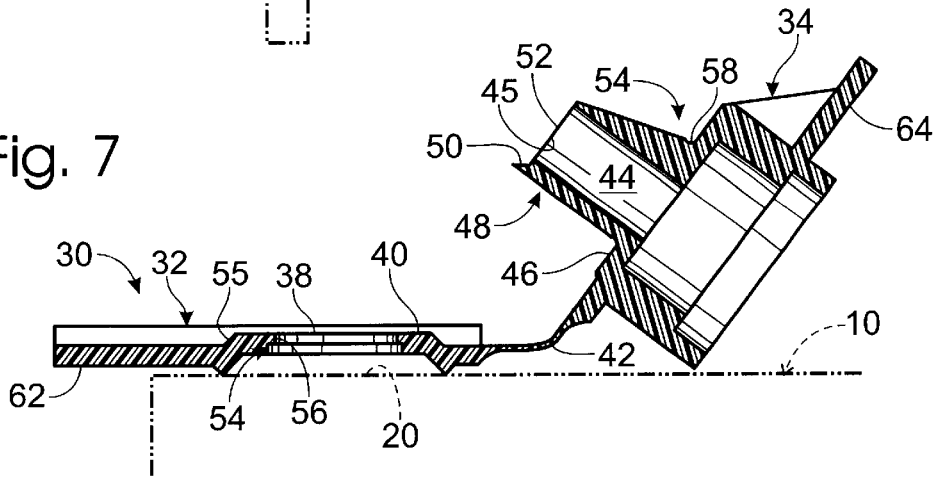
FIG. 7 is a cross-sectional view of the drink spout system of FIG. 5 with the dispensing portion removed and a drink container shown in dashed lines.

Piercing portion 34 is adapted to pierce the piercing region, or seal, of drink container 10 so that drink fluid may be withdrawn therefrom by a user. As shown in FIGS. 6–8, the piercing portion defines a fluid conduit, or passageway, 44 with an inlet 45 through which the fluid may be withdrawn from the drink container. Also shown in FIGS. 6–9 is a contact surface 46 that is adapted to engage the corresponding contact surface 40 on the base portion when the drink valve system is in the piercing orientation shown in FIG. 9.

Figure 10:
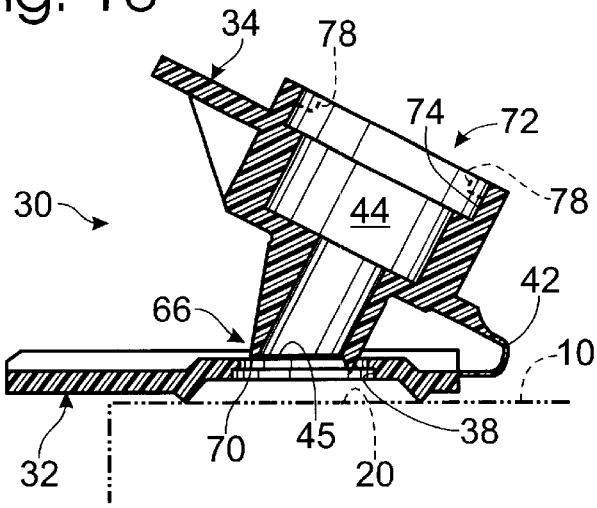
FIG. 10 is the cross-sectional view of FIG. 8 only with another suitable piercing portion.

Piercing portion 34 includes a piercing member 48 that is adapted to cut through or otherwise pierce the piercing region of the drink container. As shown in FIGS. 5–9, piercing member 48 may take the form of one or more downwardly projecting teeth 50 that are shaped or oriented to cut through piercing region 20 as the piercing member is urged toward the orientation shown in FIG. 9. Piercing member 48 may additionally, or alternatively, include a descending edge 52 that is configured to cut through the piercing region. Examples of other suitable piercing members are shown in dashed lines in FIG. 9. Yet another suitable piercing member 48 is shown in FIG. 10. As shown, the piercing member is shaped so that the region 70 of the piercing member distal hinge assembly 42 passes at least partially through aperture 38 before the piercing region is punctured by the piercing member. This configuration prevents or reduces the likelihood of drink fluid being unintentionally dispensed from the drink container as the drink spout system is being positioned into the pierced orientation. More specifically, the piercing member is oriented to contain most, if not all, of any drink fluid dispensed from the drink container prior to the piercing region being fully seated in the piercing orientation.

In the illustrated embodiment, at least a portion of fluid conduit 44 and inlet 45 are defined by piercing portion 34. It is within the scope of the present invention that the inlet of the fluid conduit, and thus the beginning of the fluid conduit, may be defined at least in part by the subsequently discussed valve assembly 70 and/or dispensing portion 36. For example, instead of forming a conduit through which drink fluid may flow, piercing portion 34 may alternatively include a piercing member that pierces the drink container's seal without itself defining a fluid conduit through which the drink fluid may flow. An example of such a piercing member is one or more teeth that extend from the piercing portion. Another example is a pivotal tooth, such as illustrated in FIGS. 21–26. In such an embodiment, the valve assembly and/or a portion of the dispensing portion extend from, and preferably at least partially within, the pierced seal of the drink container to define the conduit through which drink fluid travels as it is dispensed from the drink container.

In FIGS. 7–9, it can be seen that drink spout system 30 includes a detent assembly 54 adapted to selectively retain the piercing portion in the piercing orientation. Preferably, the detent assembly provides a seal between the base and piercing portions that prevents drink fluid from unintentionally being spilled or otherwise dispensed from the drink container after the piercing portion is in the piercing orientation. Alternatively, the base portion, piercing portion, or both may include a raised edge, gasket, washer, or some other structure to help prevent drink fluid from leaking between the portions. For example, in FIGS. 7–10, a raised ring or gasket 55 surrounds the aperture in the base portion, and in FIG. 9 another ring or gasket 57 is shown surrounding the piercing portion distal piercing member 48.

Detent assembly 54 may take the form of any suitable structure adapted to either releasably or permanently retain the base and piercing portions in the piercing orientation. An example of a suitable detent assembly 54 is shown in FIGS. 7–9 in the form of a projecting rib 56 on base portion 32 and a corresponding channel 58 on piercing portion 34. When the piercing portion is inserted a sufficient distance through aperture 38 in base portion 32, rib 56 is received within the channel 58 and retained therein. It should be understood that the position of the rib and channel could alternatively be reversed. Rib and channel 56 and 58 may also be described as a flange and edge, or lip, respectively, with the piercing portion being retained in the piercing orientation when the flange is inserted sufficiently through aperture 38 to be retained beneath the edge. Detent assembly 54 may also be referred to as a mating structure because it includes at least a plurality of portions, such as rib 56 and channel 58, that are selectively joined, or mated, to connect the base and piercing portions.

The illustrative example of detent assembly 54 enables the rib to be removed from channel 58, such as to pivot the piercing portion away from the piercing orientation. It is within the scope of the present invention, however, that detent assembly 54 may be constructed so as not to permit the removal of piercing member 48 after initial insertion through aperture 38. It should be understood that detent assembly 54 is not essential, but it is preferred, especially when the base and piercing portions are pivotally coupled together by hinge assembly 42.

In FIG. 7, it can be seen that the base and piercing portions include projecting arms 60 and 62 extending generally transverse to the long axis, or direction of fluid flow, through fluid conduit 44. The arms enable the piercing portion to be urged toward the base portion and mounted into the piercing orientation without requiring the user to grasp or exert direct pressure upon the fluid container. Instead, the user can simply pinch the arms toward each other until the contact surfaces engage each other and/or until detent assembly 54 retains the piercing portion in the piercing orientation. As shown in FIGS. 3–4 and 7–9, the arms are positioned relative to drink container 10 so that the user may urge the arms together without exerting pressure directly upon the internal compartment of the drink container. In the illustrated embodiments, at least a portion of the arms project beyond the edge of the compartment of the drink container, as measured transverse to the direction of fluid flow.

Although arms 60 and 62 are not essential to the invention, they provide a mechanism by which the drink container may be pierced without requiring the user to apply pressure directly to the container. Instead, the only force applied is by the piercing member against the piercing region as the piercing member is passed at least partially through the piercing region. As such, the arms may be described as a spill-prevention structure 66 that is adapted to prevent unintentional discharge of drink fluid from the drink container as the piercing region is pierced.

It is within the scope of the present invention that other suitable spill-prevention structures may be used. For example, the piercing portion and base portion may individually or collectively form a seal 68 that prevents drink fluid from being unintentionally dispensed between these portions and not through the dispensing portion. An example of such as seal may be formed by detent assembly 54, such as shown in FIG. 9. Another example of such a seal 68 is shown in FIG. 9, in which contact surfaces 40 and 46 engage each other when the piercing portion is in the piercing orientation. It is within the scope of the invention that surfaces 40 and 46 may include ridges, depressions or other contoured or elevated regions to enhance the spill-preventing ability of the seal. Similarly, these regions may include or be formed from a rubber or other suitable compressible material to enhance the spill-preventing ability of the seal. Another suitable seal may be formed by the piercing portion engaging the drink container to form a seal therewith. Preferably, the drink spout system includes a spill-prevention structure 66 that is adapted to prevent the unintentional discharge of drink fluid when the piercing portion is proximate the piercing orientation. An example of such a structure is shown in FIG. 10, in which the piercing portion is shaped so that the region 70 of the piercing portion that passes through aperture 38 distal hinge assembly 42 passes at least partially, and preferably completely, through the aperture prior to region 20 being pierced by piercing member 48.

Figure 16:
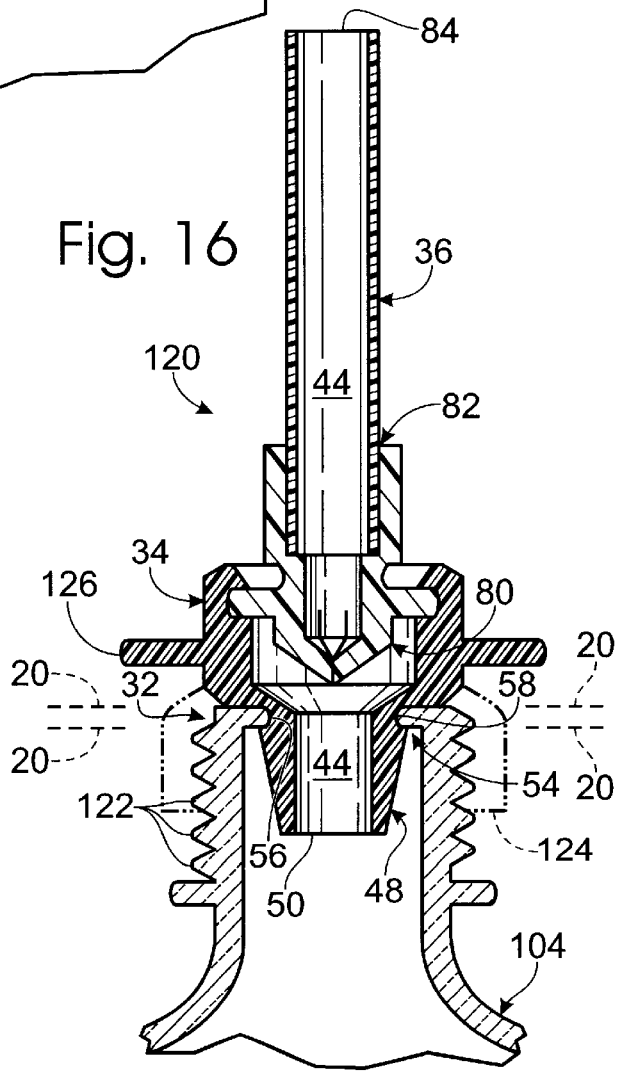
FIG. 16 is a side elevation view of the drink spout system of FIG. 15 mounted on a drink bottle.

Piercing portion 34 also provides a mount, or receptacle, 72 for dispensing portion 36. As perhaps best seen in FIGS. 10 and 11, the piercing portion defines a socket 74 into which dispensing portion 36 is at least partially inserted. As shown, the dispensing portion includes a flange 76 that is received within socket 74 to couple the dispensing portion to the piercing portion. Preferably, flange 76 forms a seal with socket 74 so that drink fluid cannot pass between the flange and socket and thereby be unintentionally dispensed from the drink spout system. As shown, the flange forms a friction or compression fit with the socket to prevent drink fluid from passing through the interface between the flange and socket 74. Flange 76 may be formed of a deformable material to provide a suitable seal without requiring precisely fitting parts. When such a construction is used, the flange will typically be slightly larger than the socket so that the flange is compressed as it is inserted into socket 74. Socket 74 may also include an edge, or lip 78, beneath which flange 76 passes when the dispensing portion is mounted on the piercing portion, such as illustrated in FIG. 16 and in dashed lines in FIG. 10.

Figure 11:
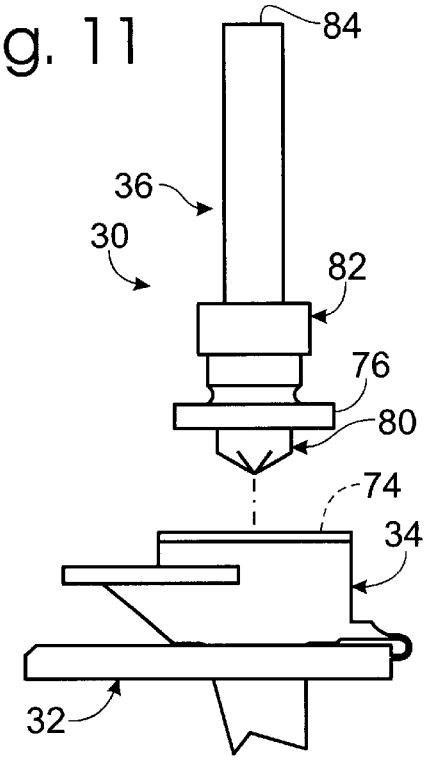
FIG. 11 is an exploded side-elevation view of the drink spout system of FIG. 5 with the dispensing portion of the system removed from the piercing portion of the system.

Although FIGS. 10 and 11 demonstrate that the piercing portion and dispensing portion are separately formed and coupled together, it is within the scope of the invention that the piercing and dispensing portions could be integrally formed or otherwise coupled together. For example, the dispensing portion may include a receptacle for piercing portion 34, the dispensing and piercing portions may be threadingly coupled together or coupled together by a friction fit, adhesive bond, heat seal or other retaining or seal structure. As used herein, the term "integrally formed" should be understood to include molding, extruding or otherwise forming the particular components from the same material or materials, as well as co-molding or co-extruding the components from different materials or combinations of materials to produce an integral assembly.

Dispensing portion 36 allows drink fluid dispensed from drink container 10 into fluid conduit 44 to be received for drinking by a user. As shown in FIG. 11, dispensing portion 36 includes a valve assembly 80, a straw structure 82 and an outlet 84. Valve assembly 80 is adapted to regulate the flow of drink fluid 18 through dispensing portion 36 by selectively preventing the flow of drink fluid through the valve assembly. The valve assembly is selectively positionable between a closed orientation, in which drink fluid may not pass through the valve assembly, and a dispensing orientation, in which drink fluid may flow through the valve assembly and be dispensed through outlet 84. Examples of a valve assembly in a closed orientation is shown in FIGS. 11 and 12, and examples of dispensing orientations are shown in FIG. 13 and in dashed lines in FIG. 12.

An example of a suitable material for valve assembly 80 is a deformable material, such as an elastomer, that may be selectively deformed from the closed orientation to permit drink fluid to flow through the valve assembly. However, it is within the scope of the present invention that the valve assembly may be formed from a rigid material that is selectively positioned to either permit or obstruct the flow of drink fluid through the fluid conduit.

Figure 12:
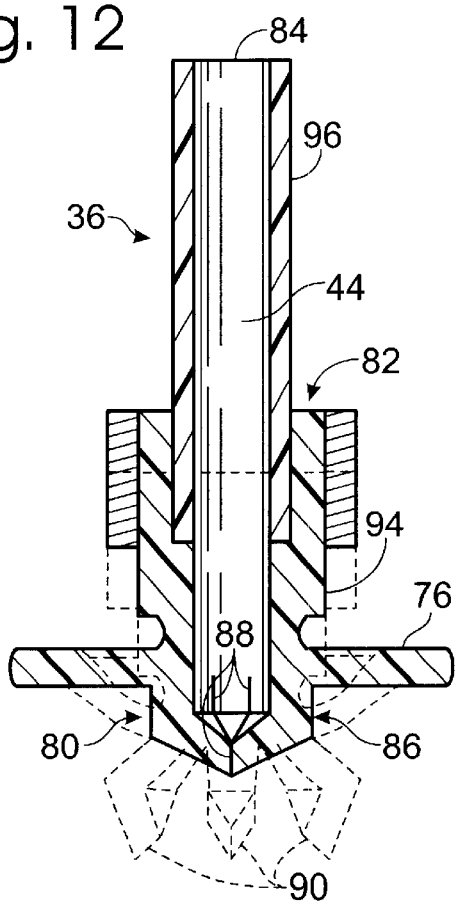
FIG. 12 is a cross-sectional view of the valve assembly of FIG. 7.
Figure 13:
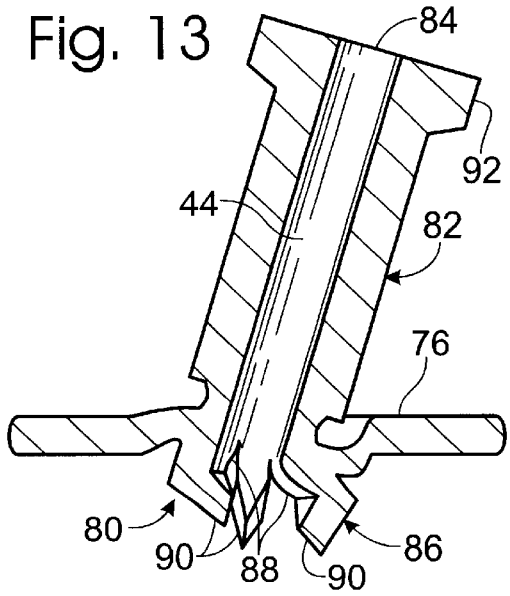
FIG. 13 is a cross-sectional view of another embodiment of a valve assembly for use with drink spout systems according to the present invention.

An illustrative example of a suitable valve assembly 80 is shown in FIGS. 11–13. As shown, the valve assembly includes a deformable expanse 86 having one or more slits 88. In the dispensing orientation, the expanse is spread apart at the slit or slits to permit drink fluid to flow therethrough; however, in the closed orientation, the expanse is not spread apart and drink fluid may not pass through the slit or slits. Although a plurality of slits 88 are shown in FIGS. 11–13, it is within the scope of the present invention that the expanse may have as few as one slit and that it may have more slits than shown in FIGS. 11–13. Valve assembly 80 may also be described as including one or more flap structures 90 that are selectively positioned between a first orientation, in which the flap structures are positioned to prevent drink fluid from passing through the valve assembly, and a second orientation, in which the flap structures are positioned to permit drink fluid to flow through the valve assembly.

In the valve assembly illustrated in FIGS. 11–13, the valve assembly is adapted to move to the dispensing orientation responsive to user-applied forces to the valve assembly. More specifically, when a downward or tilting force is applied to the valve assembly, such as respectively illustrated in FIGS. 12 and 13, the flap structure or expanse is urged generally toward the drink container and away from outlet 84. In this position, the valve assembly is in its dispensing orientation and drink fluid may flow through the valve assembly. The user-applied forces may be applied directly to the valve assembly, but typically will be applied to another portion of the drink spout system, such as to the dispensing portion, and then indirectly conveyed to the valve assembly. For example, in FIGS. 12–13, user-applied forces to straw structure 82 will be conveyed to valve assembly 80. The user-applied forces typically will be applied by a user's mouth, such as when the straw structure or mouthpiece of the system is in contact with or received into the user's mouth.

Preferably, the valve assembly is a self-sealing or automatically closing valve assembly that automatically prevents drink fluid from passing therethrough unless the user is applying pressure to maintain the valve assembly in a dispensing orientation. In such an embodiment, the valve assembly is biased to return automatically to the closed orientation upon removal of the user-applied forces. For example, when the valve assembly is formed of an elastomer, the elastomer may be configured to be in the closed orientation until user-applied forces urge the elastomer to a different orientation, such as to the dispensing orientation. The valve assembly may also be described as including biasing structure that is adapted to return the valve assembly to the closed orientation upon removal of the user-applied forces. The elastomer or other deformable material from which valve assembly 80 may be formed is an example of a suitable biasing structure. Another example is one or more resilient or spring members that are positioned adjacent the valve assembly. These members are deflected, such as being compressed or expanded, when the valve assembly is in the dispensing orientation, and automatically exert a force on the valve assembly to return to the closed orientation. When the user-applied forces are not present or are not greater than the force exerted by these members, then the valve assembly is retained in the closed orientation.

Examples of particularly well-suited valve assemblies are shown and described in co-pending U.S. patent application Ser. No. 09/639,648, which was filed on Aug. 16, 2000, is entitled "Drink Valve," and the complete disclosure of which is hereby incorporated by reference. Alternatively, the valve assembly may take other forms. For example, the drink spout system also may incorporate or be used with the features and inventions described in co-pending U.S. patent application Ser. No. 09/710,189, which was filed on Nov. 10, 2000, is entitled "Retractable Drink Spout," and the complete disclosure of which is hereby incorporated by reference. Similarly, other pressure-differential valves, such as ball valves, may be used. Also valve assemblies that are actuated by user sucking on the mouthpiece or straw structure of the valve may be used. These valve assemblies typically will also be self-sealing valve assemblies. Another example of a valve assembly that may be used is a push-pull valve, which is selectively opened and closed by a user pulling or pushing the valve to the respective orientation. Push-pull valves are not self-sealing valves. It is also within the scope of the present invention that the drink spout system may be formed without a valve assembly. As such, drink fluid may pass through the dispensing portion at all times after the seal of a drink container has been pierced by the drink spout system. In such an embodiment, a cap or clamp may be used to prevent drink fluid from being dispensed through the drink spout system.

Straw structure 82 defines at least a portion of fluid conduit 44. The straw structure may terminate at outlet 84, or alternatively may terminate prior to the outlet, such as at a mouthpiece 92 that includes the outlet. In FIG. 12, straw structure 82 is shown including a deformable portion 94 that extends from the valve assembly and a dispensing straw structure 96 that delivers the drink fluid to outlet 84. As shown, these portions are coupled together by a cinch or strap 98. It is within the scope of the invention that the portions could be retained together by any suitable mechanism, such as an adhesive bond, heat seal or friction fit, or that the members may be integrally formed. In FIG. 13, an example of a straw structure that is integrally formed with the valve assembly is shown. It is also within the scope of the present invention that the straw structure, or at least the dispensing straw structure, may be selectively removed from and replaced into engagement with the valve assembly. The dispensing straw structure may also be formed from a deformable material, or alternatively may be formed from a rigid or substantially rigid material. In FIG. 13, the straw structure is shown terminating at a mouthpiece 92 that includes outlet 84. Another example of a suitable mouthpiece is shown in FIGS. 21–24.

Figure 14:
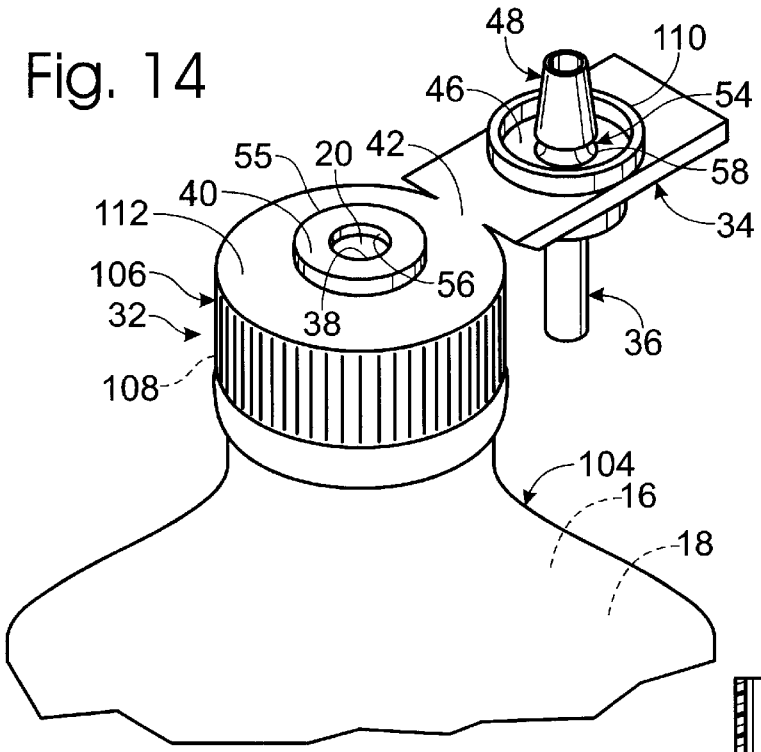
FIG. 14 is a fragmentary isometric view of a drink spout system according to the present invention and adapted for use with a drink bottle.

As discussed previously, drink container 10 may take a variety of forms, such as drink pouches, drink boxes and drink bottles. An example of drink spout system 30 adapted for use on a drink bottle 104 is shown in FIG. 14. As shown, base portion 32 includes a threaded, twist-on cap 106 that is received on the bottle's threaded opening 108. In such an embodiment, the drink spout system may be removed from the bottle by unscrewing cap 106. Alternatively, the base portion may be integrally formed with, or fixedly secured to, the bottle so that the drink spout system may not be selectively removed and replaced from the bottle. Also shown in FIG. 14 is another example of a suitable spill-prevention structure 66, namely a collar 110 that extends around ring 55 on base portion 32.

In the illustrated embodiment, piercing region 20 includes only a portion of the cap's upper surface 112, and as such the fluid conduit and straw structure have a smaller diameter than the internal diameter of the bottle's opening. It is within the scope of the invention, however, that the relative sizes of the piercing region, fluid conduit, straw structure and other components may vary, with the illustrated embodiments providing exemplary versions. For example, opening 38 may be substantially, or completely coextensive with the bottle's opening, such as discussed subsequently with respect to FIG. 16.

In the previously illustrated embodiments, the piercing and dispensing portions are pivotally coupled to base portion 32. It is within the scope of the invention that the piercing and dispensing portions may instead be independent of, or removable from the base portion. In such an embodiment, the dispensing and piercing portions may be selectively coupled to and removed from contact with the base portion, but are not at all times joined thereto, such as by a hinge assembly. Such a configuration permits the dispensing and piercing portions to be sold and/or stored separate from the base portion. In such an embodiment, the base portion will typically, but not necessarily, be integrally formed with or fastened to the drink container. This type of drink spout system may be referred to as a pop-in drink spout system.

Figure 15:
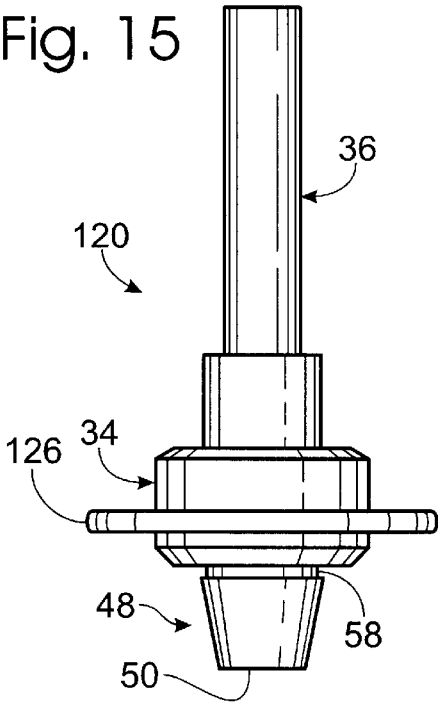
FIG. 15 is a side elevation view of another drink spout system according to the present invention.

An example of such a drink spout system is shown in FIGS. 15 and 16 and indicated generally at 120. As shown, system 120 includes a base portion 32, piercing portion 34 and dispensing portion 36. However, unlike system 30, system 120 does not include a hinge assembly pivotally coupling the piercing and dispensing portions to the base portion.

Unless otherwise indicated, system 120 includes the same elements, subelements and possible variations as discussed herein. For the sake of brevity, all possible variations and embodiments have not been repeated. For example, system 120 includes a dispensing portion 36 that includes a straw structure 82 similar to the straw 20 structure shown and discussed with respect to FIG. 12 except without a cinch or band 98. The straw structure may include such a cinch or band, as well as any of the other possible straw structures discussed herein. Rather than repeating these possible straw structures in combination with the rest of system 120, FIGS. 15 and 16 are instead used to illustrate an embodiment of a straw structure in which the deformable portion and dispensing straw structure are joined together by a friction fit or structural bond, such as an adhesive bond or heat seal or the like. It should be understood that this variation of the straw structure may also be used with the system 30.

In FIG. 16, system 120 is shown mounted on a drink container 10 in the form of a drink bottle 104. In the illustrated embodiment, base portion 32 is integrally formed with the drink bottle. As shown, portion 32 defines an opening 38 through which at least a portion of piercing portion 34 is inserted. Not shown in FIG. 15 is a seal or piercing region 20 of the drink container that is adapted to be pierced by the piercing portion. As discussed, seal 20 may be formed from any suitable material, such as plastic, foil, paper and combinations thereof. The piercing region, or seal extends across at least a portion of opening 38. For example, seal 20 may extend across the opening in the positions indicated with dashed lines in FIG. 16. Seal 20 may also extend across a portion of the top portion of a threaded cap of drink bottle 94. For example, the bottle may be prepackaged with such a cap, and then system 120 may be mounted on the cap if a user wants to utilize a drink spout with the bottle.

Also shown in FIG. 16 is detent assembly 54 that is adapted to retain the piercing portion in its piercing orientation, which is shown in FIG. 16. For non-pivotal embodiments of the drink spout system, the piercing portion is in its open configuration when the piercing portion is separate from the base portion, such as shown in FIG. 15. Another suitable detent assembly is for piercing portion 34 to include a threaded shell that engages threads 122 on the drink bottle. An example of such a shell is shown in dashed lines in FIG. 16 and generally indicated at 124.

In the illustrated embodiment, piercing portion 34 includes a flange 126 that may be grasped by the user when mounting the piercing portion on base portion 32. Flange 126 may take any suitable form, such as one or more arms projecting from the piercing portion or a ring extending all the way around the piercing portion. Flange 126 illustrates an example of a spill-prevention structure adapted for use on drink spout systems that have independent base and piercing portions. By exerting a downward force on flange 126, the user may urge piercing member 48 through seal 20 without directly imparting sufficient force to valve assembly 80 to move the valve assembly to its dispensing orientation and without requiring the user to squeeze the deformable sides of the drink bottle.

Although previously illustrated being mounted on a drink bottle, it should be understood that drink spout system 120 may be used with other types of drink containers, such as drink boxes and drink pouches. For example, system 120 is shown in FIG. 17 mounted on a drink container 10 in the form of a drink box. In FIG. 18, drink spout system 120 is shown mounted on a drink pouch. As discussed, the outlet 84 of the drink spout may be the terminal end of the dispensing portion's straw structure 82. However, it may also be part of a mouthpiece 92 that receives drink fluid from straw structure 82 and the fluid conduit defined at least partially thereby. An example of a suitable mouthpiece was discussed previously with respect to FIG. 13. Other examples are shown in FIGS. 19 and 20 and indicated generally at 128. It should be understood that the term "mouthpiece" is meant to include portions of the drink spout system that are shaped to be received into a user's mouth and to not include a simple straw structure, such as shown in FIGS. 17 and 18. In other words, the term "mouthpiece" is meant to refer to a portion of the drink spout system that is mounted onto the straw structure or extends from the straw structure.

Another embodiment of a piercing drink spout system according to the present invention is shown in FIGS. 21–26 and generally indicated at 140. System 140 may be referred to as a twist spout system because the system pierces the drink container's seal responsive to the user twisting or rotating a portion of the system relative to the system's central axis, which is generally indicated at 142 in FIG. 21. Unless otherwise indicated, system 140 may have any of the elements, subelements and variations discussed herein with respect to drink spout systems 30 and 120.

Similar to the previously discussed systems, drink spout system 140 includes a base portion 32, a piercing portion 34 with a piercing member 48, a dispensing portion 36 with a mouthpiece 128, a fluid conduit 44 with an inlet 45 and an outlet 84, a valve assembly 80, and a straw structure 82. Unlike the previously described embodiments, the dispensing portion is adapted to be rotated relative to the base portion to cause the piercing portion to pierce region 20 on drink container 10, which as discussed, may be a drink box, drink pouch or drink bottle.

In the illustrated embodiment, dispensing portion 36 includes a projecting member 144 that may be gripped by the user to rotate the dispensing portion relative to base portion 32 and drink container 10. Member 144 may also be described as being an orientation-indicating member because the relative position of member 144 relative to indicia on base portion 32 or container 10 may be used to indicate to a user the current orientation of the drink spout system, as discussed in more detail subsequently. It is within the scope of the present invention, however, that dispensing portion 36 may be formed without member 144, such as shown in dashed lines in FIG. 21. Similarly, the dispensing portion may include other grip-enhancing structure 146, such as ridges or grooves 147 that assist a user in gripping and rotating the dispensing portion.

As shown in FIG. 22, piercing portion 34 is pivotally coupled to base portion 32 by hinge assembly 42. In the illustrated embodiment, the piercing and base portions are integrally formed, but it is within the scope of the invention that the portions may be separately formed and thereafter joined by a suitable hinge assembly. Piercing portion 34 includes a piercing member 48 in the form of a pawl 148 containing a plurality of teeth 149 that are adapted to pierce region 20 of a drink container when the piercing portion is pivoted in the direction indicated with an arrow in FIG. 22. As discussed in more detail subsequently, rotating the dispensing portion in the indicated direction causes a cam assembly 152 to pivot the piercing portion in the indicated direction. Although a plurality of teeth are shown in FIGS. 22–24, piercing member 48 may have any suitable configuration, such as a single tooth, a descending edge, or the like, that is adapted to pierce seal 20.

Figure 25:
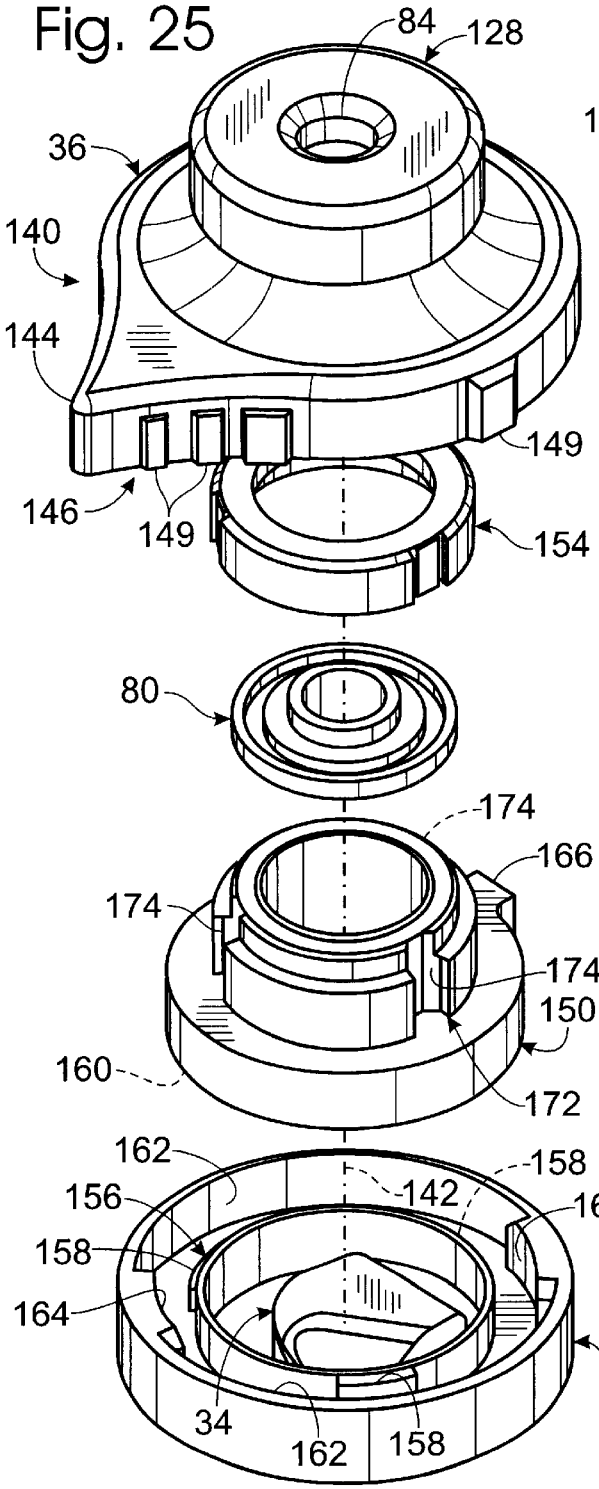
FIG. 25 is an exploded isometric view of the drink spout system of FIG. 21 taken from above the drink spout system.
Figure 26:
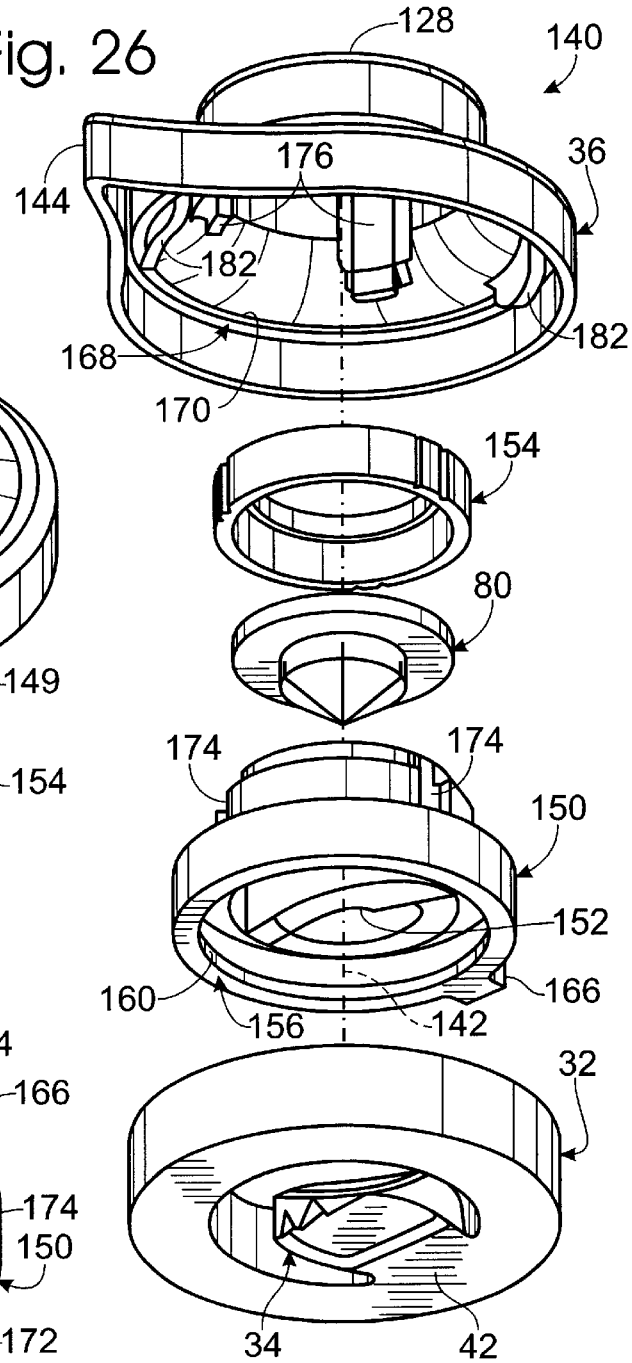
FIG. 26 is an exploded isometric view of the drink spout system of FIG. 21 taken from below the drink spout system.

The construction of system 140 is perhaps best seen by referring to FIGS. 23–26. As shown in FIGS. 25–26, system 140 includes the previously discussed base portion 32, piercing portion 34, dispensing portion 36 and valve assembly 80. Also shown is another example of a suitable grip-enhancing structure 146, namely, knurls 149. Several knurls are shown, and it should be understood that they may be spaced partially or completely around dispensing portion 36. In the illustrated embodiment, system 140 also includes a housing 150 with a cam assembly 152 adapted to selectively urge the piercing portion to the piercing orientation responsive to rotation of the dispensing portion by a user. As shown, valve assembly 80 is mounted on housing 150 and retained thereupon by a retainer 154. It should be understood that any other suitable mechanism for coupling valve assembly 80 to housing 150 may be used, such as co-molding the valve assembly with housing 150, heat sealing the valve assembly to the housing, snap-fitting the valve assembly on the housing, or other mechanisms discussed herein.

Figure 27:
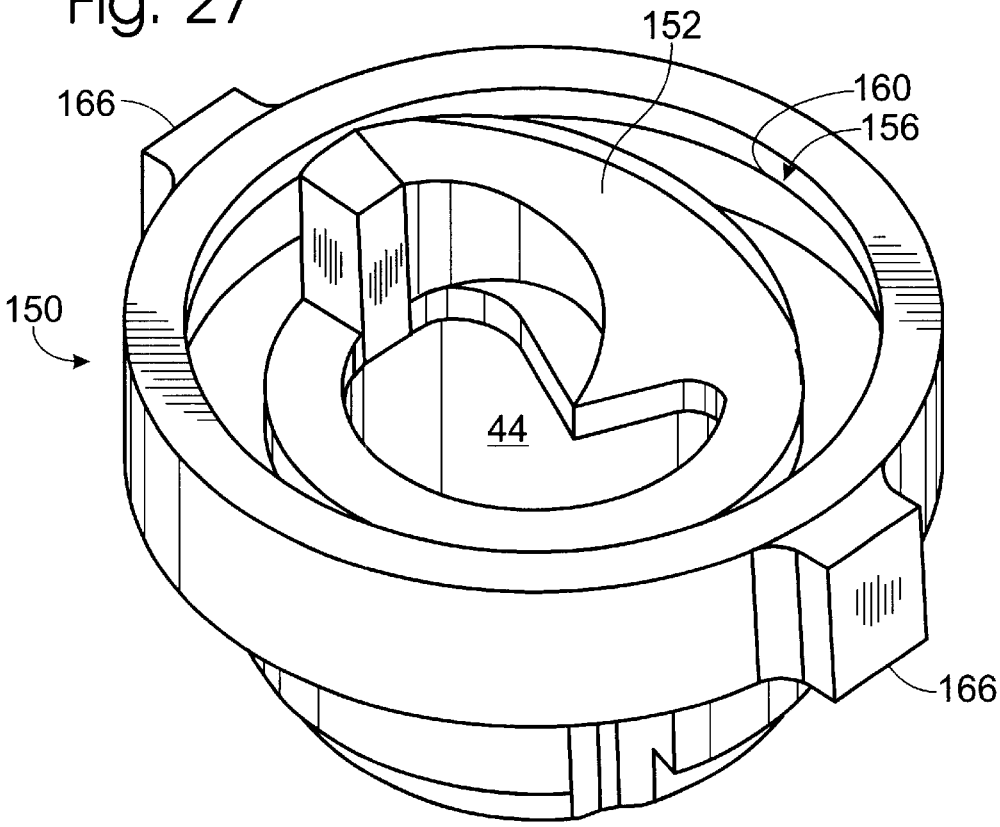
FIG. 27 is an isometric view of the lower surface of another embodiment of the base portion of the drink spout system of FIG. 21.

As perhaps best seen in FIGS. 23–25, the housing may rotate within an arcuate track 162 relative to base portion 32. In the illustrated embodiment, the base portion includes stops 164 that define the rotational bounds of the track, and the housing includes one or more guides 166 that travel within the track. Although only a single guide 166 is shown in FIG. 25, more than one guide may be used, such as shown in FIG. 27. When a guide engages one of the stops 164, the housing cannot rotate further in that direction relative to the base portion. In the illustrated embodiment, the track extends for less than 180°, although any suitable rotational extent may be used. Base portion 32 or container 10 may include indicia, such as letters, symbols or the like, that indicate to the user the system's orientations along track 162.

Housing 150 is coupled to base portion 32 by a fastening mechanism 156 that enables the housing to rotate relative to the track, while retaining the housing and base portion in a generally constant horizontal plane relative to each other. An example of a suitable fastening mechanism 156 is shown in FIGS. 24–26, in which it may be seen that base portion 32 includes a plurality of tabs 158 that extend from the base portion to engage an internal lip 160 on housing 150. Any other suitable fastening mechanism may be used.

As discussed, however, the rotational position of the housing relative to base portion 32 also defines at least in part the relative position of piercing portion 34 relative to base portion 32. As the housing rotates within track 162 in the direction indicated in FIG. 22, cam assembly 152 is selectively drawn into engagement with piercing portion 34 to urge the piercing portion away from base portion 32. When the dispensing portion is rotated in the reverse direction, the cam assembly releases the piercing portion. Preferably, hinge assembly 42 is adapted to retain the piercing portion at least substantially in the piercing orientation even after the cam assembly no longer engages the piercing portion to prevent the piercing portion from obstructing the flow of drink fluid through fluid conduit 44.

Dispensing portion 36 is coupled to the base or housing of the drink spout system by a suitable fastening mechanism 168 that couples the housing and dispensing portions together to rotate as a unit relative to the base portion, while enabling the dispensing portion to selectively travel in a vertical plane relative to the housing and base portion. An example of a suitable fastening mechanism 168 is shown in FIGS. 23 and 26, in which it can be seen that dispensing portion 36 includes an internal lip 170 that extends at least partially beneath retainer 154 to limit the vertical distance dispensing portion 36 may travel relative to the retainer, and thus the housing and base portion.

Figure 28:
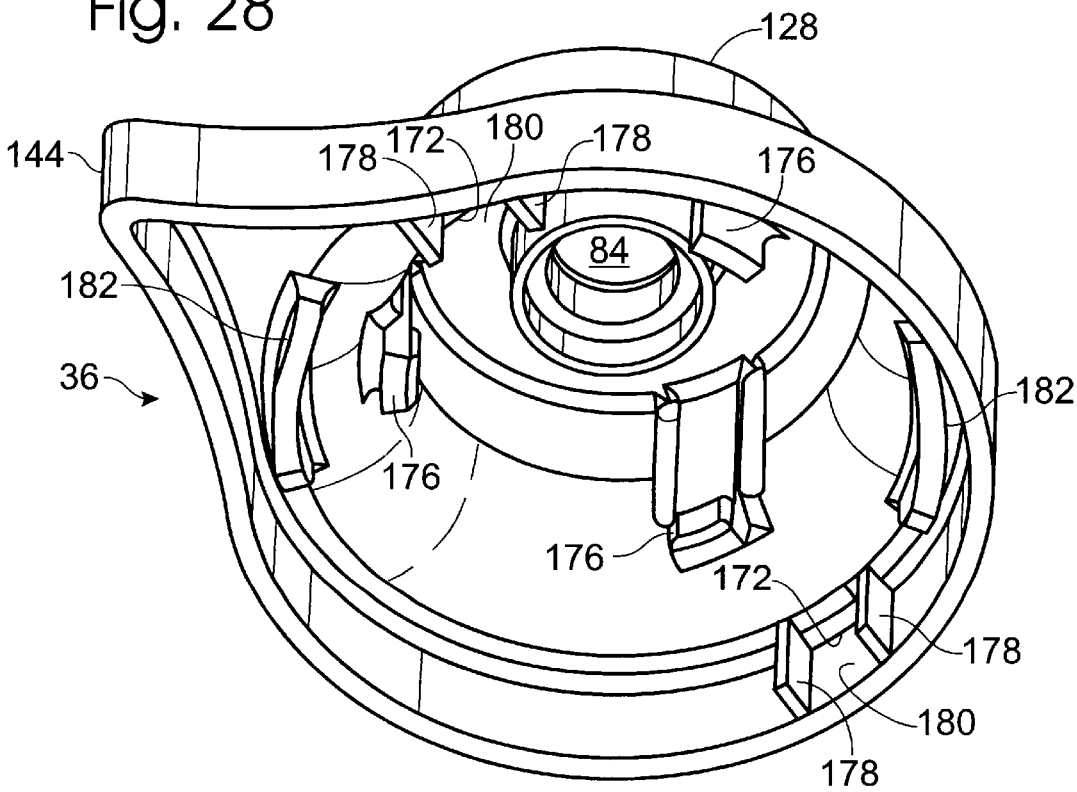
FIG. 28 is an isometric view of the lower surface of another embodiment of the dispensing portion of the drink spout system of FIG. 21.

Housing 150 further defines a vertical track 172 within which dispensing portion 36 may selectively travel relative to the housing and base portion. As perhaps best seen in FIGS. 25 and 26, housing 150 includes a plurality of vertically elongate recesses, or guides, 174 with which corresponding ribs 176 on dispensing portion 36 are received or otherwise engaged. In the illustrated embodiment, three such recesses and ribs are shown, however, more or less recesses and ribs may be used. Track 172 may alternatively or additionally be defined by projections 178 on dispensing portion 36 that define pockets 180 into which guides 166 are received to rotationally couple the dispensing portion and housing together, such as shown in FIGS. 27 and 28.

As discussed, the dispensing portion is rotatable relative to base portion 32 and may be selectively vertically adjusted relative thereto. More specifically, dispensing portion 36 includes supports 182 that extend generally toward the base portion. When the supports are rotationally aligned with stops 164 on the base portion, the dispensing portion is prevented from moving toward the base portion, thereby preventing user-applied forces from configuring valve assembly 80 to a dispensing orientation. However, upon rotation of the dispensing portion relative to the base portion, the supports and stops are no longer aligned, and the mouthpiece may be moved toward the base portion, such as with a generally downward movement. These user-applied forces to the dispensing portion, such as applied by a user's mouth to mouthpiece 128 are communicated to valve assembly 80 to urge the valve assembly to a dispensing orientation. This assembly provides another example of a spill-prevention structure because it prevents the valve assembly from being urged to a dispensing orientation until the piercing portion has pierced the drink container's seal. Therefore, if there is pressure on the drink container while drink spout system 140 is configured into its piercing orientation, drink fluid emitted through seal 20 will not pass through valve assembly 80 because the valve assembly cannot be configured to its dispensing orientation. In some embodiments, it may be desirable for valve assembly to be urged to its dispensing orientation prior to the piercing portion being in its fully pierced orientation.

System 140 provides an additional spill-prevention structure by the fact that drink fluid passing through seal 20 can only be dispensed through outlet 84. In other words, system 140 provides a closed boundary around seal 20 from which drink fluid may only be dispensed through outlet 84.

Similar to the other drink spout systems described herein, it should be understood that system 140 may utilize a variety of mouthpieces and/or straw structures. System 140 may also utilize any suitable type of valve assembly, including those discussed and incorporated herein. It may also be formed without a valve assembly. In embodiments that do not include a valve assembly, or which include a valve assembly that is not depressed to a dispensing orientation, it should be understood that the spill-prevention assembly provided by stops 164 and supports 182 will not be required. If system 140 incorporates a valve assembly that is urged away from the base portion to a dispensing orientation, such as a push-pull valve assembly or a valve assembly that is actuated by sucking on the mouthpiece or straw structure, then the system may include an analogous spill-prevention assembly that restricts the valve assembly from being drawn away from the base portion until the dispensing portion is rotated a determined amount relative to the base portion.

It is believed that the disclosure set forth above encompasses multiple distinct inventions with independent utility. While each of these inventions has been disclosed in its preferred form, the specific embodiments thereof as disclosed and illustrated herein are not to be considered in a limiting sense as numerous variations are possible. The subject matter of the inventions includes all novel and non-obvious combinations and subcombinations of the various elements, features, functions and/or properties disclosed herein. Similarly, where the claims recite "a" or "a first" element or the equivalent thereof, such claims should be understood to include incorporation of one or more such elements, neither requiring nor excluding two or more such elements.

It is believed that the following claims particularly point out certain combinations and subcombinations that are directed to one of the disclosed inventions and are novel and non-obvious. Inventions embodied in other combinations and subcombinations of features, functions, elements and/or properties may be claimed through amendment of the present claims or presentation of new claims in this or a related application. Such amended or new claims, whether they are directed to a different invention or directed to the same invention, whether different, broader, narrower or equal in scope to the original claims, are also regarded as included within the subject matter of the inventions of the present disclosure.

INDUSTRIAL APPLICABILITY

The invented drink spout systems are applicable in the drink packaging and other liquid packaging industries, and are specifically applicable to drink containers such as aseptic drink pouches and boxes and plastic and glass bottles.

We Claim:

1. A drink spout system, comprising:

a dispensing portion having an outlet through which drink fluid may be dispensed from the system and a fluid conduit through which drink fluid may flow;

a valve assembly associated with the dispensing portion and configured to regulate the flow of drink fluid through the fluid conduit, wherein the valve assembly is selectively configurable between a dispensing orientation, in which the valve assembly is adapted to permit the flow of drink fluid through the valve assembly to the outlet, and a closed orientation, in which the valve assembly is adapted to obstruct the fluid conduit and prevent drink fluid from flowing through the valve assembly to the outlet, wherein the valve assembly is adapted to be configured from the closed orientation to the dispensing orientation responsive to user-applied forces, and wherein the valve assembly is further adapted to return automatically to the closed orientation upon removal of the user-applied forces; and a piercing portion associated with the dispensing portion and adapted to pierce a container of drink fluid to allow drink fluid to flow to the valve assembly and, when the valve assembly is in the dispensing orientation, through the outlet.

2. The drink spout system of claim 1, wherein the user-applied forces include at least one of a tilting or downward force on the valve assembly in a direction generally away from the outlet.

3. The drink spout system of claim 1, wherein the valve assembly includes a pressure-differential valve.

4. The drink spout system of claim 1, further comprising a mounting structure associated with the dispensing portion and a mating structure adapted to be attached to a drink container, wherein the mounting structure and the mating structure are configured to connect together to hold the dispensing portion on the drink container.

5. The drink spout system of claim 4, wherein the mounting structure includes a flange, wherein the mating structure includes a lip, and further wherein the flange overlaps the lip to connect the mounting structure and the mating structure.

6. The drink spout system of claim 1, wherein the valve assembly includes a deformable expanse biased to extend across the fluid conduit to prevent the flow of drink fluid through the fluid conduit when the valve assembly is in the closed orientation.

7. The drink spout system of claim 6, wherein the expanse includes at least one slit associated with the expanse, and further wherein in the dispensing orientation the expanse is spread apart at the at least one slit.

8. The drink spout system of claim 1, wherein the valve assembly includes at least one flap structure configured to move between a first orientation in which the at least one flap structure prevents the flow of drink fluid through the valve assembly when the valve assembly is in the closed orientation, and a second orientation, in which the at least one flap structure does not prevent the flow of drink fluid through the valve assembly when the valve assembly is in the dispensing orientation.

9. The drink spout system of claim 8, wherein the at least one flap structure is biased to return toward the closed orientation.

10. The drink spout system of claim 8, wherein the at least one flap structure is adapted to move toward the second orientation responsive to user-applied forces imparted to the at least one flap structure.

11. The drink spout system of claim 10, wherein the user-applied forces include at least one of a tilting or downward force urging the at least one flap structure generally toward the piercing portion.

12. The drink spout system of claim 11, wherein the at least one flap structure is biased to return toward the first orientation upon removal of the user-applied forces.

13. The drink spout system of claim 1, wherein the valve assembly includes biasing structure that biases the valve assembly to the closed orientation.

14. The drink spout system of claim 1, wherein the fluid conduit is further defined in part by the piercing portion.

15. The drink spout system of claim 1, wherein the dispensing portion includes a straw structure.

16. The drink spout system of claim 15, wherein the straw structure forms at least a portion of the fluid conduit.

17. The drink spout system of claim 16, wherein the straw structure includes a dispensing straw structure adapted to deliver drink fluid to a user's mouth.

18. The drink spout system of claim 17, wherein the dispensing straw structure is at least substantially rigid.

19. The drink spout system of claim 17, wherein the dispensing straw structure includes a mouthpiece.

20. The drink spout system of claim 15, wherein the straw structure includes a mouthpiece.

21. The drink spout system of claim 1, wherein the dispensing portion includes a mouthpiece with the outlet through which drink fluid is dispensed from the drink spout system.

22. The drink spout system of claim 1, wherein the piercing portion includes a piercing member adapted to pierce a drink container.

23. The drink spout system of claim 22, wherein the piercing member includes a terminal edge of the piercing portion distal the outlet.

24. The drink spout system of claim 22, wherein the piercing member includes at least one tooth adapted to pierce a drink container.

25. The drink spout system of claim 22, wherein the piercing member forms a portion of the fluid conduit.

26. The drink spout system of claim 22, wherein the piercing member includes a pivotal member adapted to pivot generally away from the valve assembly to a position for piercing a drink container.

27. The drink spout system of claim 26, wherein the system further includes a piercing member biasing structure adapted to urge the pivotal member to a position for piercing a drink container.

28. The drink spout system of claim 27, wherein the piercing member biasing structure includes at least one cam assembly that upon rotation of a portion of the drink spout system biases the pivotal member to the position for piercing a drink container.

29. The drink spout system of claim 28, wherein the portion includes the dispensing portion.

30. The drink spout system of claim 1, in combination with a drink container having an internal compartment housing a drink fluid and a region adapted to be pierced by the piercing portion.

31. The drink spout system of claim 30, further including a base portion mounted on the container.

32. The drink spout system of claim 31, wherein the piercing portion is pivotally coupled to the base portion by a hinge assembly and selectively pivotal between an open orientation, in which the piercing portion is not in a position to pierce the region of the drink container, and a piercing orientation, in which the piercing portion is in a position for piercing the region of the drink container.

33. The drink spout system of claim 32, wherein the piercing portion and the hinge assembly are integrally formed with the base portion.

34. The drink spout system of claim 32, further including a detent assembly adapted to selectively retain the piercing portion in the piercing orientation.

35. The drink spout system of claim 32, further including spill-prevention structure adapted to prevent leaks between the base portion and the piercing portion when the piercing portion is in the piercing orientation.

36. The drink spout system of claim 32, further including spill-prevention structure adapted to prevent leaks between the base portion and the piercing portion when the piercing portion is proximate the piercing orientation.

37. The drink spout system of claim 30, wherein the container includes a mount adapted to receive the piercing portion.

38. The drink spout system of claim 37, wherein the mount at least partially surrounds the piercing portion.

39. The drink spout system of claim 38, wherein the mount completely surrounds the piercing portion.

40. The drink spout system of claim 39, wherein the mount is adapted to form a seal with the piercing portion when the piercing portion is received by the mount.

41. The drink spout system of claim 39, wherein the mount includes at least a portion of a detent assembly adapted to retain the piercing portion in the mount when the piercing portion is received by the mount.

42. The drink spout system of claim 37, wherein the drink container is a bottle having a threaded opening, and further wherein the mount includes a threaded, twist-on cap.

43. A drink spout system, comprising:

means for dispensing drink fluid from a drink container;

means for piercing a drink container to permit drink fluid to be dispensed from the drink container; and means for regulating the flow of drink fluid from the drink container, wherein the means for regulating the flow of drink fluid from the drink container include a valve assembly associated with the means for dispensing drink fluid, wherein the valve assembly is configured to regulate the flow of drink fluid through the means for regulating the flow of drink fluid, wherein the valve assembly is selectively configurable between a dispensing orientation, in which the valve assembly is adapted to permit the flow of drink fluid through the valve assembly, and a closed orientation, in which the valve assembly is adapted to prevent drink fluid from flowing through the valve assembly, wherein the valve assembly is adapted to be configured from the closed orientation to the dispensing orientation responsive to user-applied forces, and wherein the valve assembly is further adapted to return automatically to the closed orientation upon removal of the user-applied forces.

44. The drink spout system of claim 43, wherein the means for regulating the flow of drink fluid from the drink container include means for preventing drink fluid from being unintentionally dispensed from the drink container through the valve assembly.

45. The drink spout system of claim 43, wherein the user-applied forces include at least one of a tilting or downward force urging the valve assembly toward the dispensing orientation.

46. The drink spout system of claim 43, wherein the valve assembly includes a pressure-differential valve.

47. The drink spout system of claim 43, wherein the means for piercing includes a piercing member adapted to pierce a drink container.

48. The drink spout system of claim 47, wherein the piercing member includes a pivotal member adapted to pivot generally away from the valve assembly to a position for piercing a drink container.

49. The drink spout system of claim 48, wherein the system further includes a piercing member biasing structure adapted to urge the pivotal member to a position for piercing a drink container.

50. The drink spout system of claim 49, wherein the piercing member biasing structure includes at least one cam assembly that upon rotation of a portion of the drink spout system biases the pivotal member to the position for piercing a drink container.

51. The drink spout system of claim 50, wherein the portion includes the means for dispensing.

52. The drink spout system of claim 43, in combination with a drink container having an internal compartment housing a drink fluid and a region adapted to be pierced by the means for piercing.

53. The drink spout system of claim 52, wherein the drink container is an aseptic drink container.

* * * * *